US008447203B2

(12) United States Patent
Tai et al.

(10) Patent No.: US 8,447,203 B2
(45) Date of Patent: May 21, 2013

(54) REDUCING TONER CRACKING WITH SCREENING PATTERNS

(75) Inventors: Hwai-Tzuu Tai, Rochester, NY (US); Thomas N. Tombs, Rochester, NY (US); Brian J. Kwarta, Pittsford, NY (US); Donald S. Rimai, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 331 days.

(21) Appl. No.: 12/795,946

(22) Filed: Jun. 8, 2010

(65) Prior Publication Data

US 2011/0299869 A1 Dec. 8, 2011

(51) Int. Cl.
*G03G 15/00* (2006.01)

(52) U.S. Cl.
USPC ..... 399/82; 399/53; 399/407

(58) Field of Classification Search
USPC ..... 399/82, 407, 45, 53; 358/455
See application file for complete search history.

(56) References Cited

U.S. PATENT DOCUMENTS

| | | | | |
|---|---|---|---|---|
| 5,187,594 A | | 2/1993 | Deutsch et al. | 358/3.13 |
| 5,404,156 A | * | 4/1995 | Yamada et al. | 347/115 |
| 5,956,157 A | | 9/1999 | Tai | 358/3.24 |
| 7,537,556 B2 | * | 5/2009 | Bober | 493/23 |
| 7,704,663 B2 | | 4/2010 | Ide | 430/120.1 |
| 2008/0159786 A1 | | 7/2008 | Tombs et al. | 399/222 |
| 2008/0166647 A1 | | 7/2008 | Mang et al. | 430/108.4 |
| 2008/0252062 A1 | | 10/2008 | Kelley | 281/21.1 |

FOREIGN PATENT DOCUMENTS

| | | |
|---|---|---|
| JP | 2006-209427 | 8/2006 |
| JP | 2007-084324 | 4/2007 |
| JP | 2008-310123 | 12/2008 |
| WO | 2008/051943 | 5/2008 |

OTHER PUBLICATIONS

"Paper Reinvented," Graphic Arts Monthly, Mar. 2010, pp. 16-19.

* cited by examiner

*Primary Examiner* — Sophia S Chen
(74) *Attorney, Agent, or Firm* — Christopher J. White

(57) ABSTRACT

Toner is applied to a receiver having an area to be folded and a separate area not to be folded. Non-fold and fold-area screening patterns are selected. The non-fold screening pattern has a toner coverage greater than 50% and the fold-area screening pattern has a toner coverage less than 50%. Image data to be applied to the receiver in the area to be folded and the area not to be folded are received. The image data in the area not to be folded are processed using the non-fold screening pattern and the image data in the area to be folded are processed using the fold-area screening pattern to provide screened data. Toner corresponding to the screened data is applied to the receiver. The applied toner is fused to the receiver, so that the area to be folded includes fused toner.

8 Claims, 13 Drawing Sheets

REDUCING TONER CRACKING WITH SCREENING PATTERNS

CROSS-REFERENCE TO RELATED APPLICATIONS

Reference is made to commonly assigned, co-pending U.S. patent application Ser. No. 12/777,317, filed May 11, 2010, entitled "MAKING BOOKLET BY ITERATIVELY FOLDING AND CUTTING," by Chowdry et al., the disclosure of which is incorporated by reference herein.

FIELD OF THE INVENTION

This invention pertains to the field of producing printed sheets to form booklets, and more particularly to producing such printed sheets produced using electrophotography.

BACKGROUND OF THE INVENTION

Customers of print jobs can require finishing steps for their jobs. These steps include, for example, folding printed or blank sheets, cutting sheets, trimming sheets to size and shape, cutting specialty shapes into the edges or interior of a sheet, forming multiple sheets into bound signatures or booklets, binding individual pages or signatures into books, and fastening covers to books by e.g. stapling, saddle-stitching, or gluing. Signature production requires folding a large printed sheet and cutting the folded stack so that the resulting cut pages are in sequential order.

When producing a booklet by folding sheets and nesting them together, toner applied to the fold area of a sheet can crack, reducing image quality along the fold. This can be particularly noticeable on the cover of a booklet.

Numerous approaches to reducing toner cracking have been proposed. For example, Japanese publication no. 2007-084324 to Morita describes heating toner in the fold area while folding. This requires an additional heater, and can reduce image quality if warm, partially-liquid toner runs or contacts other toner or parts of the machine. U.S. Publication No. 2008/0166647 to Mang et al. describes a toner formulated to reduce cracking, and Wales describes XTREME COATED COVER paper by MILLMAR PAPER, which includes a laminated coating to reduce cracking (Wales, Trish. "Paper reinvented." *Graphic Arts Monthly* March 2010: 16-19, esp. pg. 18). However, it is desirable to permit use of a wide variety of toners and papers in a printer.

WO 2008/051943 to Jacobs et al. describes a system for detecting problems resulting from the interaction of toner and finishing system and providing a user the choice of alternative finishing methods. However, full-bleed covers (for example) must be printed across fold lines, so no alternative finishing methods exist.

U.S. Publication No. 2008/0252062 to Kelley describes a method for scoring one or more sheets in a booklet at two different and parallel locations to reduce the stress on toner at a fold line. However, this scheme can only be applied to double-creased booklets, which approximate the look of a perfect-bound book. It is desirable to produce booklets of various spine shapes.

Japanese Publication No. 2006-209427 to Sugita describes a system for reducing density of an image in a fold area. However, Sugita reduces density, after ripping (para. 37-38) but before screening or halftoning (paras. 44, 49), by limiting the total amount of toner applied per unit area to less than a selected maximum toner total amount (paras. 16, 24, 40) by multiplying the ripped gray levels with the toner limit (paras. 42, 48). This can result in highly-visible color shifts and other objectionable visual differences between the fold area and the non-fold area.

Commonly-assigned U.S. Publication No. 2008/0159786 to Tombs et al., the disclosure of which is incorporated herein by reference, describes printing raised information with a distinct tactile feel using electrophotographic techniques. Toner stack heights of at least 20 μm are provided. As toner stack height increases, the probability of toner cracking along fold lines also increases.

There is a continuing need, therefore, for a way of reducing toner cracking in fold areas without producing objectionable artifacts.

SUMMARY OF THE INVENTION

Applicants have determined that toner cracking is correlated with toner coverage, not merely with toner amount. Therefore, according to an aspect of the present invention, there is provided a method of operating a printer to apply toner to a receiver having an area to be folded and a separate area not to be folded, comprising:

selecting a non-told screening pattern and a fold-area screening pattern wherein the non-fold screening pattern has a toner coverage greater than 50% and the fold-area screening pattern has a toner coverage less than 50%;

receiving image data to be applied to the receiver in the area to be folded and the area not to be folded;

processing the image data in the area not to be folded using the non-fold screening pattern and the image data in the area to be folded using the fold-area screening pattern to provide screened data;

using the printer to apply toner corresponding to the screened data to the receiver; and fusing the applied toner to the receiver, so that the area to be folded includes fused toner.

According to another aspect of the present invention, there is provided a method of operating a printer to apply toner to a receiver, comprising:

providing the receiver with an area to be folded and a separate area not to be folded;

selecting a fold-area screening pattern having a screen period, and having a screen direction;

designating a fold axis in the area to be folded, the fold axis extending in a particular direction, that makes an angle having a magnitude of less than 45° with the screen direction so that when the receiver is folded, a fold zone will be produced having a width and disposed adjacent to, or containing, the fold axis, and after toner is fused to the receiver, either i) no areas of fused toner will intersect the fold zone; or ii) one or more areas of fused toner will intersect the field zone and the width of each area measured perpendicular to the screen direction intersecting the fold zone will be less than the screen period;

receiving image data to be applied to the receiver in the area to be folded;

processing the image data in the area to be folded using the fold-area screening pattern to provide screened data;

using the printer to apply toner corresponding to the screened data to the receiver; and fusing the applied toner to the receiver.

Various embodiments of this invention reduce toner cracking without degrading image quality. The invention advantageously maintains hue and chroma and reduces density (increases lightness). Various embodiments do not require any special folding or scoring equipment, but can be implemented in software in the raster image processor.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
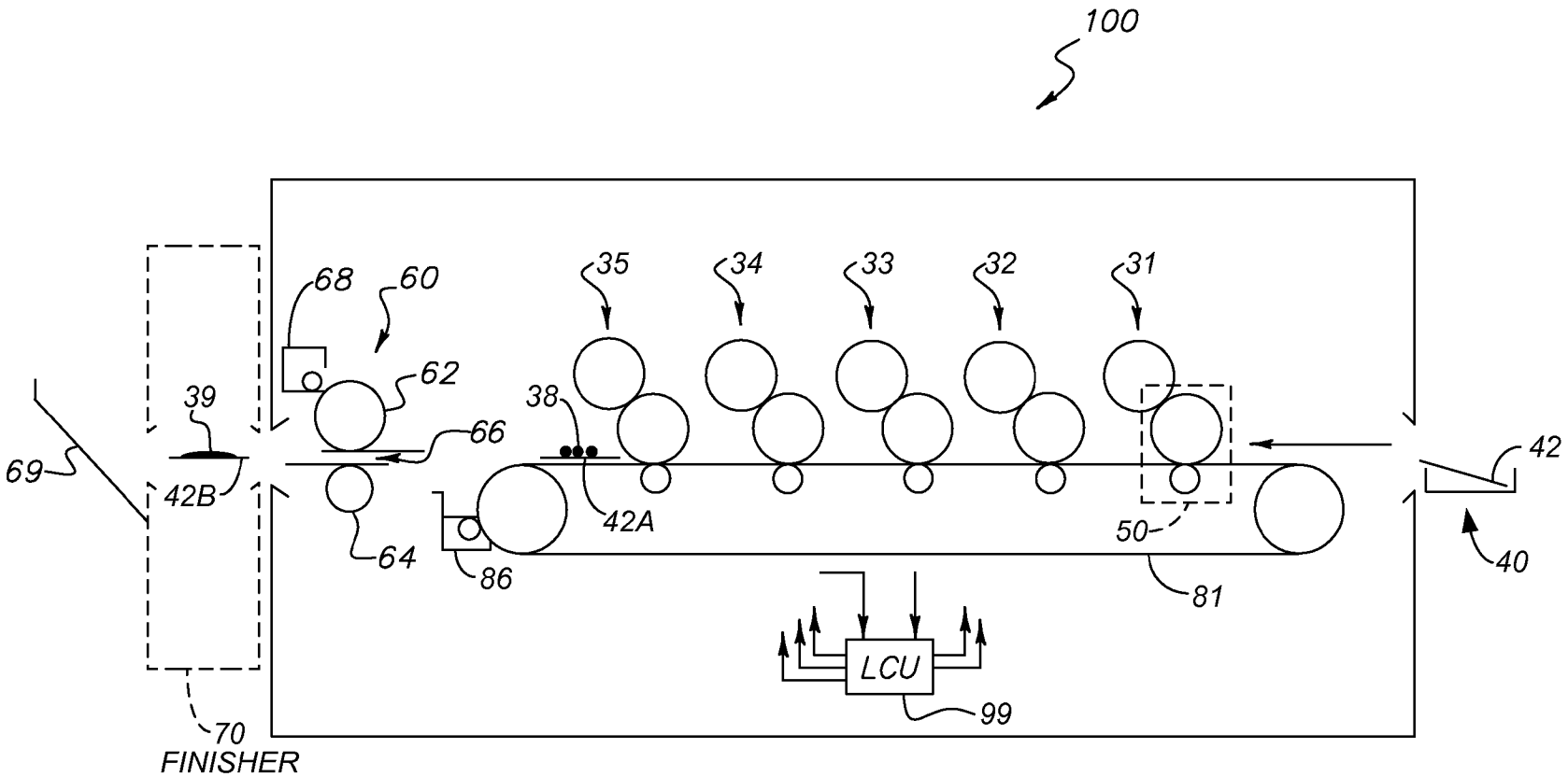
FIG. 1 is an elevational cross-section of an electrophotographic reproduction apparatus suitable for use with this invention.

The attached drawings are for purposes of illustration and are not necessarily to scale.

DETAILED DESCRIPTION OF THE INVENTION

As used herein, the terms "parallel" and "perpendicular" have a tolerance of ±5°. In a preferred embodiment, structures set parallel and perpendicular maintain a tolerance of ±1°.

As used herein, "sheet" is a discrete piece of media, such as receiver media for an electrophotographic printer (described below). Sheets have a length and a width. Sheets are folded along fold axes, e.g. axes positioned in the center of the sheet in the length dimension and extending the full width of the sheet. "Face" refers to one side of one sheet, whether before or after folding.

As used herein, a "fold" is not required to have a sharp crease. Larger radii of curvature are generally known as "bends" and smaller radii of curvature as "folds," but the present invention does not distinguish between these, and is effective with both. Both bends and folds can cause toner cracking that can be mitigated as described herein.

In the following description, some embodiments of the present invention will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, the method in accordance with the present invention. Other aspects of such algorithms and systems, and hardware or software for producing and otherwise processing the image signals involved therewith, not specifically shown or described herein, are selected from such systems, algorithms, components, and elements known in the art. Given the system as described according to the invention in the following, software not specifically shown, suggested, or described herein that is useful for implementation of the invention is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method according to the present invention.

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, charged toner particles are brought into the vicinity of the photoreceptor and are attracted to the latent image to develop the latent image into a visible image. Note that the visible image may not be visible to the naked eye depending on the composition of the toner particles (e.g. clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g. of separations of different colors, are overlaid on one receiver before fusing to form a multi-color print image on the receiver.

Electrophotographic (EP) printers typically transport the receiver past the photoreceptor to form the print image. The direction of travel of the receiver is referred to as the slow-scan or process direction. This is typically the vertical (Y) direction of a portrait-oriented receiver. The direction perpendicular to the slow-scan direction is referred to as the fast-scan or cross-process direction, and is typically the horizontal (X) direction of a portrait-oriented receiver. "Scan" does not imply that any components are moving or scanning across the receiver; the terminology is conventional in the art.

As used herein, "toner particles" are particles of one or more material(s) that are transferred by an EP printer to a receiver to produce a desired effect or structure (e.g. a print image, texture, pattern, or coating) on the receiver. Toner particles can be ground from larger solids, or chemically prepared (e.g. precipitated from a solution of a pigment and a dispersant using an organic solvent), as is known in the art. Toner particles can have a range of diameters, e.g. less than 8 μm, on the order of 10-15 μm, up to approximately 30 μm, or larger ("diameter" refers to the volume-weighted median diameter, as determined by a device such as a Coulter Multisizer).

"Toner" refers to a material or mixture that contains toner particles, and that can form an image, pattern, or coating when deposited on an imaging member including a photoreceptor, photoconductor, or electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

Toner includes toner particles and can include other particles. Any of the particles in toner can be of various types and have various properties. Such properties can include absorption of incident electromagnetic radiation (e.g. particles containing colorants such as dyes or pigments), absorption of moisture or gases (e.g. desiccants or getters), suppression of bacterial growth (e.g. biocides, particularly useful in liquid-toner systems), adhesion to the receiver (e.g. binders), electrical conductivity or low magnetic reluctance (e.g. metal particles), electrical resistivity, texture, gloss, magnetic remnance, florescence, resistance to etchants, and other properties of additives known in the art.

In single-component or monocomponent development systems, "developer" refers to toner alone. In these systems, none, some, or all of the particles in the toner can themselves be magnetic. However, developer in a monocomponent system does not include magnetic carrier particles. In dual-component, two-component, or multi-component development systems, "developer" refers to a mixture of toner and magnetic carrier particles, which can be electrically-conductive or -non-conductive. Toner particles can be magnetic or non-magnetic. The carrier particles can be larger than the toner particles, e.g. 20-300 μm in diameter. A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

In various embodiments, dry toner particles, or toner particles used in a dry electrophotographic print engine, are used, or the toner is dry toner. In an embodiment, toner particles having diameters≧1 μm are used, or the toner includes toner particles having diameters≧1 μm. The electrophotographic process can be embodied in devices including printers, copiers, scanners, and facsimiles, and analog or digital devices, all of which are referred to herein as "printers." Various aspects of the present invention are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine useful with the present invention, e.g. the NEXPRESS 2100 printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

FIG. 1 is an elevational cross-section showing portions of a typical electrophotographic printer 100 useful with the present invention. Printer 100 is adapted to produce images, such as single-color (monochrome), CMYK, or pentachrome (five-color) images, on a receiver (multicolor images are also known as "multi-component" images). Images can include text, graphics, photos, and other types of visual content. One embodiment of the invention involves printing using an electrophotographic print engine having five sets of single-color image-producing or -printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to a receiver. The receiver is, for example, a selected section of a web of, or a cut sheet of, planar media such as paper or transparency film.

Each receiver, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g. metallic, fluorescent, or pearlescent colors), or a clear toner.

Receiver 42A is shown after passing through printing module 35. Print image 38 on receiver 42A includes unfused toner particles.

Subsequent to transfer of the respective print images, overlaid in registration, one from each of the respective printing modules 31, 32, 33, 34, 35, the receiver is advanced to a fuser 60, i.e. a fusing or fixing assembly, to fuse the print image to the receiver. Transport web 81 transports the print-image-carrying receivers to fuser 60, which fixes the toner particles to the respective receivers by the application of heat and pressure. The receivers are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed with the present invention. For example, solvent fixing uses solvents to soften the toner particles so they bond with the receiver. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers (e.g. receiver 42B) carrying the fused image (e.g. fused image 39) are transported in a series from the fuser 60 along a path either to a remote output tray 69, or back to printing modules 31 et seq. to create an image on the backside of the receiver, i.e. to form a duplex print. Receivers can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various paper-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003, to Peter S. Alexandrovich et al., and in U.S. Publication No. 2006/0133870, published on Jun. 22, 2006, by Yee S. Ng et al., the disclosures of which are incorporated herein by reference.

Part One

Figure 2:
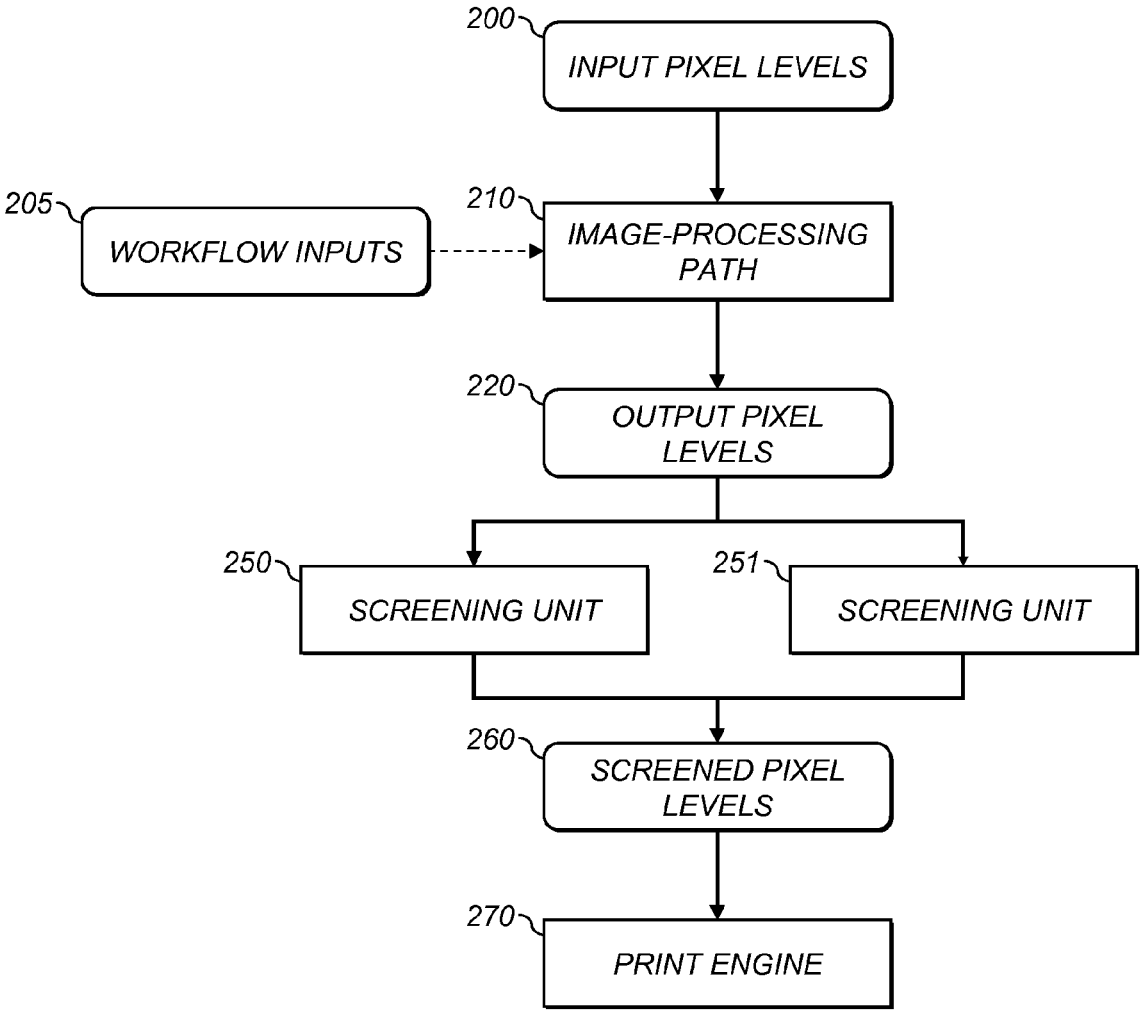
FIG. 2 is a schematic of a data-processing path according to an embodiment of the present invention.

FIG. 2 shows a data-processing path according to an embodiment of the present invention, and defines several terms used herein. Printer 100 (FIG. 1) or corresponding electronics (e.g. the DFE or RIP), described herein, operate this datapath to produce image data corresponding to exposure to be applied to a photoreceptor of an imaging member, as described above. The datapath can be partitioned in various ways between the DFE and the print engine, as is known in the image-processing art.

The following discussion relates to a single pixel; in operation, data processing takes place for a plurality of pixels that together compose an image. The term "resolution" herein refers to spatial resolution, e.g. in cycles per degree. The term "bit depth" refers to the range and precision of values. Each set of pixel levels has a corresponding set of pixel locations. Each pixel location is the set of coordinates on the surface of receiver 42 (FIG. 1) at which an amount of toner corresponding to the respective pixel level should be applied.

Printer 100 receives input pixel levels 200. These can be any level known in the art, e.g. sRGB code values (0 . . . 255) for red, green, and blue (R, G, B) color channels. There is one pixel level for each color channel. Input pixel levels 200 can be in an additive or subtractive space. Image-processing path 210 converts input pixel levels 200 to output pixel levels 220, which can be cyan, magenta, yellow (CMY); cyan, magenta, yellow, black (CMYK); or values in another subtractive color space. Output pixel level 220 can be linear or non-linear with respect to exposure, L*, or other factors known in the art.

Image-processing path 210 transforms input pixel levels 200 of input color channels (e.g. R) in an input color space (e.g. sRGB) to output pixel levels 220 of output color channels (e.g. C) in an output color space (e.g. CMYK). In various embodiments, image-processing path 210 transforms input pixel levels 200 to desired CIELAB (CIE 1976 L*a*b*; CIE Pub. 15:2004, 3rd. ed., §8.2.1) values or ICC PCS (Profile Connection Space) LAB values, and thence optionally to values representing the desired color in a wide-gamut encoding such as ROMM RGB. The CIELAB, PCS LAB or ROMM RGB values are then transformed to device-dependent CMYK values to maintain the desired colorimetry of the pixels. Image-processing path 210 can use optional workflow inputs 205, e.g. ICC profiles of the image and the printer 100, to calculate the output pixel levels 220. RGB can be converted to CMYK according to the Specifications for Web Offset Publications (SWOP; ANSI CGATS TR001 and CGATS.6), Euroscale (ISO 2846-1:2006 and ISO 12647), or other CMYK standards.

Input pixels are associated with an input resolution in pixels per inch (ippi, input pixels per inch), and output pixels with an output resolution (oppi). Image-processing path 210 scales or crops the image, e.g. using bicubic interpolation, to change resolutions when ippi≠oppi. The following steps in the path (output pixel levels 220, screened pixel levels 260) are preferably also performed at oppi, but each can be a different resolution, with suitable scaling or cropping operations between them.

Screening units 250 and 251 calculate screened pixel levels 260 from output pixel levels 220. Screening unit 250 can perform continuous-tone (processing), halftone, multitone, or multi-level halftone processing, and can include a screening memory or dither bitmaps. Screened pixel levels 260 are at the bit depth required by print engine 270. Screening units 250 and 251 apply respective, different screening patterns to output pixel levels 220, as will be described further below. In another embodiment, a single screening unit 250 is used, and screening unit 250 includes logic to select the appropriate one of two different screening patterns for each output pixel level 220 to use to produce the corresponding screened pixel level 260.

Print engine 270 represents the subsystems in printer 100 that apply an amount of toner corresponding to the screened pixel levels to a receiver 42 (FIG. 1) at the respective screened pixel locations. Examples of these subsystems are described above with reference to FIG. 1. The screened pixel levels and locations can be the engine pixel levels and locations, or additional processing can be performed to transform the screened pixel levels and locations into the engine pixel levels and locations.

Figure 3:
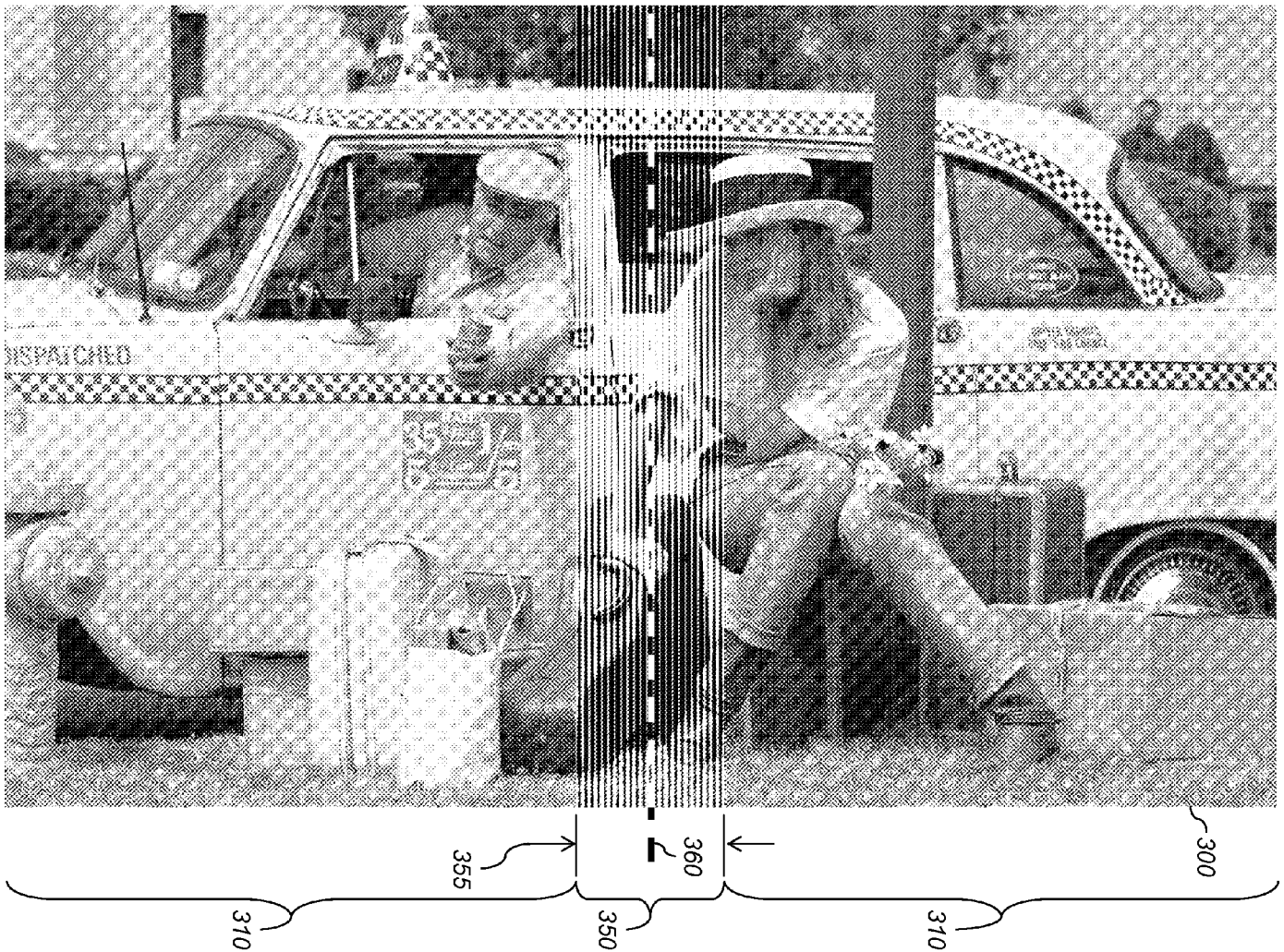
FIG. 3 is a magnified view of a grayscale image halftoned along a fold line according to an embodiment of the present invention.

FIG. 3 is a magnified view of a grayscale image halftoned along a fold line according to an embodiment of the present invention. The grayscale image has only one separation, black, which is shown here. For a color image having e.g. C, M, Y, and K separations, the invention can be applied to each separation individually.

Image 300 includes an area to be folded, fold area 350, having width 355, and an area not to be folded, non-fold area 310. This figure shows image 300 on one face of one sheet. The sheet will be folded in fold area 350 to form a booklet, but is shown here before folding for clarity. Non-fold area 310 is shown on both sides of fold area 350, but the extent of non-fold area 310 does not have to be equal on both sides of fold area 350. The sheet will be folded along fold axis 360. Width 355 is preferably less than or equal to 8 mm, and fold area 350 preferably extends ±4 mm or less from fold axis 360. In various embodiments, a single receiver 42 can be folded once or more than once (e.g. twice for the cover of a perfect-bound book), so each receiver 42 to be folded can have ≧1 fold area(s) 350.

In various embodiments, the present invention is applied to the inside or outside faces of inner sheets or covers. Width 355 is preferably smaller for thinner substrates than for thicker substrates, e.g. is proportional to the thickness of receiver 42 (FIG. 1). This is because thinner substrates can have smaller radii of curvature, providing less volume into which to squeeze the toner on the sheet. Width 355 is also preferably smaller for inside faces of folded sheets than for outside faces of folded sheets. This is because the inside face of a fold presses toner particles into a smaller volume, and the outside face of a fold expands the toner particles into a larger volume.

In an embodiment, the concentration of toner is reduced down more on the inside of a fold than the outside of the fold. This is particularly advantageous when the fold is creased, pressing toner particles on the inside of the fold very close together, and increasing the chance of toner cracking.

In another embodiment, toner stack heights of at least 20 μm are deposited on receiver 42. This invention is particularly useful with thick toner, which is more rigid than thin toner when fused, so more difficult to bend and therefore more vulnerable to cracking.

A different screening pattern is used for fold area 350 than for non-fold area 310. The screening pattern in fold area 350 provides reduced toner cracking compared to the screening pattern in non-fold area 310, as is discussed further below.

Figure 4A:
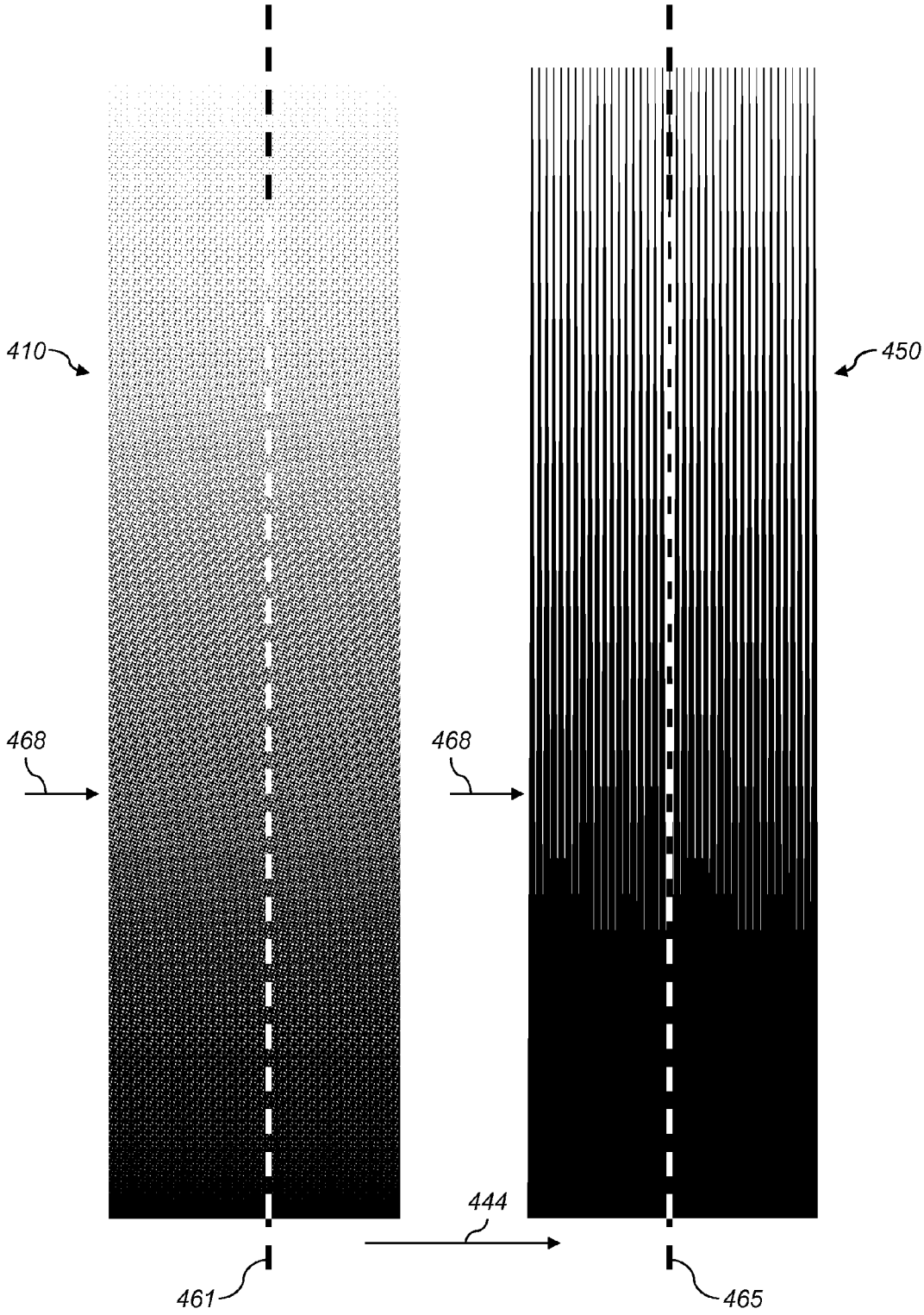
FIG. 4A is a magnified view of two screening patterns useful with the present invention.

FIG. 4A is a magnified view of two screening patterns useful with the present invention. In an embodiment, non-fold screening pattern 410, e.g. processed by first screening unit 250 (FIG. 2), is used in non-fold area 310 (FIG. 3) and fold-area screening pattern 450, e.g. processed by second screening unit 251 (FIG. 2), is used in fold area 350 (FIG. 3). Screening pattern 410 is a multitoned dot pattern with a 75° screen angle and a screen frequency of 150 lines per inch (lpi), rendered for a printer capable of printing 600 dots per inch (dpi). That is, there are 600 screened pixel levels 260 (FIG. 2) per linear inch on the printed page. Fold-area screening pattern 450 is a multitoned line pattern with a 90° screen angle and 75 lpi at 600 dpi.

In various embodiments, fold-area screening pattern 450 has a different screen angle, dot type, dot growth pattern, dot shape, dot size, cell size, or multitoning level (i.e. number of engine pixel levels) than non-fold screening pattern 410. Non-fold and fold-area screening patterns 410, 450, respectively, can be oriented in any direction; they do not have to be parallel or perpendicular to an edge of receiver 42 or to fold axis 360. Screen angles and other orientation parameters of screening patterns can be selected to reduce the visibility of Moiré patterns, reduce granularity, or enhance color gamut, as is known in the art. For example, fold-area screening pattern 450 has a screen frequency in lpi approximately equal to half of the screen frequency of non-fold screening pattern 410.

In embodiments with multiple overprinted separations, non-fold and fold-area screening patterns 410, 450, respectively, are selected to follow screen design rules. For example, in AM screens, screen angles and frequencies are selected so that their interference terms have very low frequencies or very high frequencies, and as such in either case are not visible to the eye. Various screen design rules will be obvious to one skilled in the art.

Image data screened with fold-area screening pattern 450 have smaller contiguous areas (clumps) of toner, measured in the direction perpendicular to fold axis 360, than the same data screened with non-fold screening pattern 410. For example, at density 468, non-fold screening pattern 410 has solid toner for the full width of the swath. The open portions of the halftone dots do not provide any clean break points to arrest toner cracking if the swath of non-fold screening pattern 410 is folded on fold axis 461 extending along the long axis of the swath. Fold axis 461 is provided in fold area 350 (FIG. 3). However, fold-area screening pattern 450 is a plurality of stripes with gaps between them across the swath at density 468. Therefore folding the swath of fold-area screening pattern 450 on fold axis 465 extending along the long axis of the swath results in reduced toner cracking compared to non-fold screening pattern 410, because any cracking is arrested at the gaps, and cracking is less likely to begin because individual contiguous areas of toner are shorter in direction 444 parallel to fold axes 461 and 465. In an embodiment, connectivity between dots is in a direction parallel to fold axis 360.

Figure 4B:
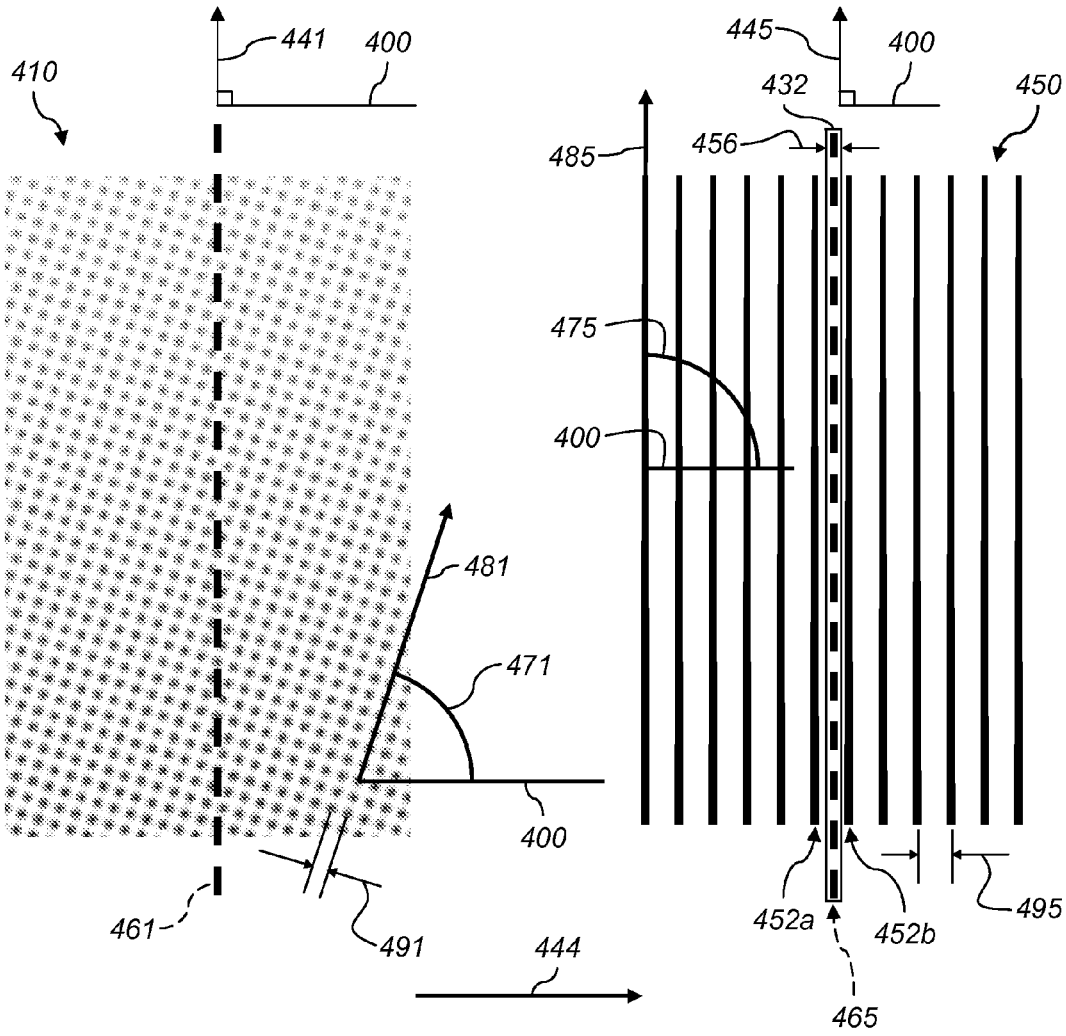
FIG. 4B is a further-magnified view of portions of the patterns of FIG. 4A.

FIG. 4B is a further-magnified view of portions of the patterns of FIG. 4A. Non-fold screening pattern 410, fold-area screening pattern 450, direction 444, fold axis 461, and fold axis 465 are as shown in FIG. 4A. Baseline 400 is a selected reference for measuring angles. Baseline 400 can be selected arbitrarily, but the same orientation of baseline 400 is used as the reference for all angles shown in FIG. 4B. In this example, direction 444 has the same orientation as baseline 400. Fold axis 461 extends in direction 441, and fold axis 465 extends in direction 445.

Non-fold screening pattern 410 extends in screen direction 481 characterized by screen angle 471 (here, 75°) between screen direction 481 and baseline 400. Fold-area screening pattern 450 extends in screen direction 485 characterized by screen angle 475 (here, 90°) between screen direction 485 and baseline 400. In an embodiment, screen direction 485 of fold-area screening pattern 450 is parallel to direction 445 of fold axis 465.

Each screening pattern has a screen frequency in lines per inch (or lines per mm). The inverse of the screen frequency is the screen period (in inches per line), the distance between two adjacent screen cells. Non-fold screening pattern 410 has screen period 491, and fold-area screening pattern 450 has screen period 495. In various embodiments, fold-area screening pattern 450 has a larger screen period (i.e. a lower screen frequency) than non-fold screening pattern 410. That is, screen period 495 is greater than screen period 491.

Figure 5:
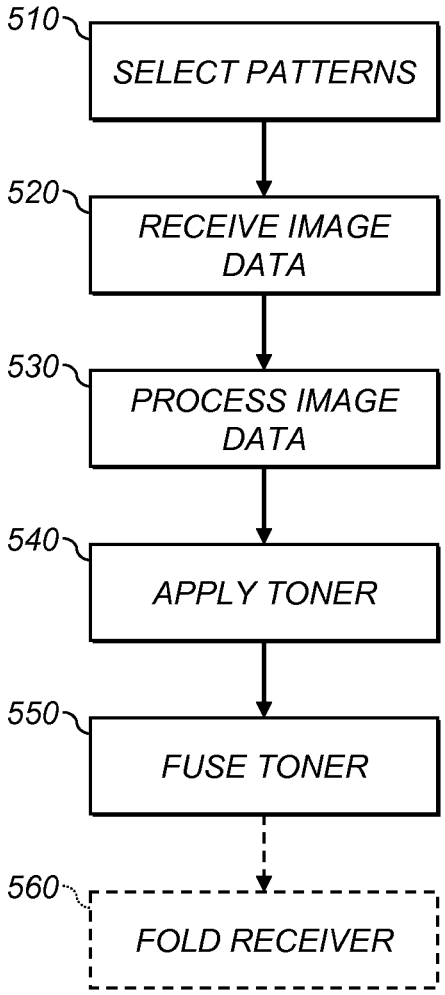
FIG. 5 is a flowchart of a method according to an embodiment of the present invention.

FIG. 5 is a flowchart of a method of applying toner to a receiver having an area to be folded and a separate area not to be folded according to an embodiment of the present invention.

Processing begins with step 510, in which a non-fold screening pattern and a fold-area screening pattern are selected. The non-fold screening pattern has a toner coverage greater than 50% and the fold-area screening pattern has a toner coverage less than 50%. Step 510 is followed by step 520. "Toner coverage" refers to the percent of the surface area of the face of receiver 42 that is covered by fused toner, regardless of the stack height of the fused toner.

In step 520, image data are received, which data are to be applied to the receiver in the area to be folded (e.g. fold area 350, FIG. 3) and the area not to be folded (e.g. non-fold area 310, FIG. 3). Step 520 is followed by step 530.

In step 530, the image data are processed to provide screened data. Image data in the area not to be folded are processed using the non-fold screening pattern. Image data in the area to be folded are processed using the fold-area screening pattern. Step 530 is followed by step 540.

In step 540, toner corresponding to the screened data is applied to the receiver. In an embodiment, the toner is applied using an electrophotographic print engine as described above with reference to FIG. 1. Step 540 is followed by step 550.

In step 550, the applied toner is fused to the receiver as described above with reference to FIG. 1. The area to be folded therefore includes fused toner. Step 550 is optionally followed by step 560.

In an embodiment, step 560 includes folding the receiver in the fold area after fusing. This can be accomplished using a buckle folder or knife folder as known in the art. An exemplary buckle folder useful with the present application is shown in commonly-assigned U.S. Pat. No. 5,108,082 to Shea et al., the disclosure of which is incorporated herein by reference.

Figure 6:
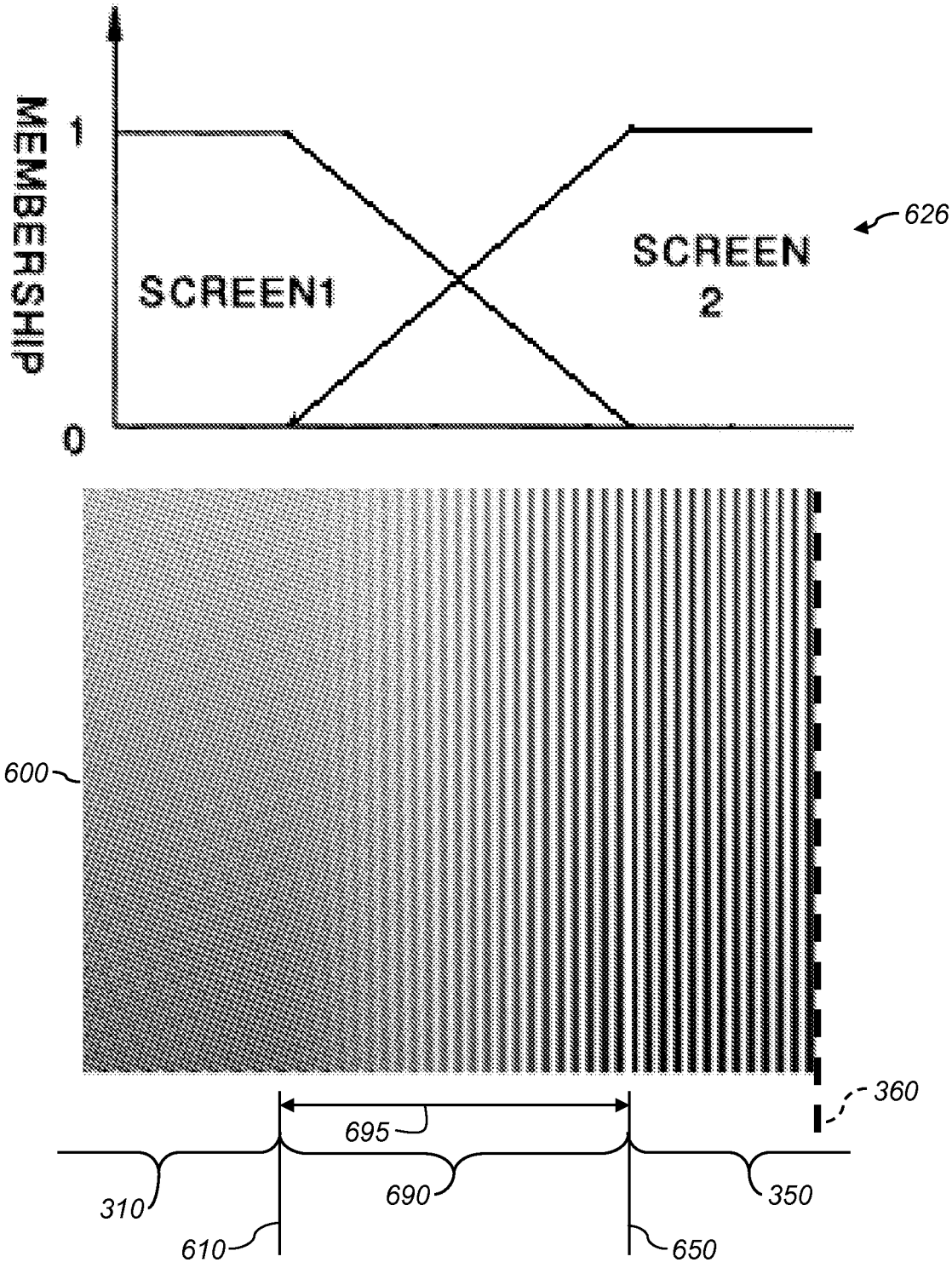
FIG. 6 is a magnified view of a grayscale image halftoned along a fold line according to another embodiment of the present invention.

FIG. 6 is a magnified view of a simulated grayscale image halftoned along a fold line according to another embodiment of the present invention. Image 600 is shown on one face of one sheet before folding, as in FIG. 3. Non-fold area 310, fold area 350, and fold axis 360 are as shown in FIG. 3.

Transition area 690 with width 695 is disposed laterally between the area to be folded (fold area 350) and the area not to be folded (non-fold area 310). Image data in transition area 690 are processed using a combination of the non-fold and fold-area screening patterns. In this simulation, the two screening patterns are blended in Photoshop using gradient layer masks. A method of combining screening patterns useful with the present invention is set forth in commonly-assigned U.S. Pat. No. 5,956,157 to Tai, the disclosure of which is incorporated herein by reference. Graph 626 shows an example of weights from 0 (no contribution) to 1 (full contribution) useful with this invention.

Referring also to FIGS. 2 and 5, in an embodiment, step 520 further includes receiving image data to be applied to the receiver in the transition area. Step 530 further includes processing the received image data in transition area 690 using a combination of the non-fold screening pattern and the fold-area screening pattern to provide the screened data. In an embodiment, each image datum (output pixel level 220) in transition area 690 is processed with both the non-fold and fold-area screening pattern, and the screened pixel level 260 output is a weighted sum of the respective results of processing with the non-fold and fold-area screening patterns. The weights are selected based on the position of the pixel in the transition area. At boundary 610 between transition area 690 and non-fold area 310, the weight assigned to pixels processed with the non-fold screening pattern is substantially equal to 1.0 (100%), e.g. >0.9, >0.95, or >0.99, and the weight assigned to pixels processed with the fold-area screening pattern is substantially equal to 0.0 (0%), e.g. <0.1, <0.05, or <0.01. At boundary 650 between transition area 690 and fold area 350, the weight assigned to pixels processed with the fold-area screening pattern is substantially equal to 1.0 (100%), e.g. >0.9, >0.95, or >0.99, and the weight assigned to pixels processed with the non-fold screening pattern is substantially equal to 0.0 (0%), e.g. <0.1, <0.05, or <0.01. The weights change according to a selected profile between those two boundaries. In various embodiments, the weights change monotonically, according to a continuous or discontinuous function, or smoothly (according to a continuous function with a continuous first derivative, and optionally a continuous second derivative or continuous third derivative). Alternatively, in an embodiment in which non-fold and fold-area screening patterns have different screen angles, screen angle can vary, preferably monotonically and more preferably smoothly, across transition area 690, being substantially equal to the screen angle of the non-fold screening pattern at boundary 610 and substantially equal to the screen angle of the fold-area screening pattern at boundary 650.

In another embodiment, the toner density of the fused image is determined along a line segment perpendicular to fold axis 360. The line segment has a length between 1 mm and 4 mm. The image density is reduced along the line segment so that the areal dot coverage adjacent to the fold line is between 30% and 50%.

Figure 7:
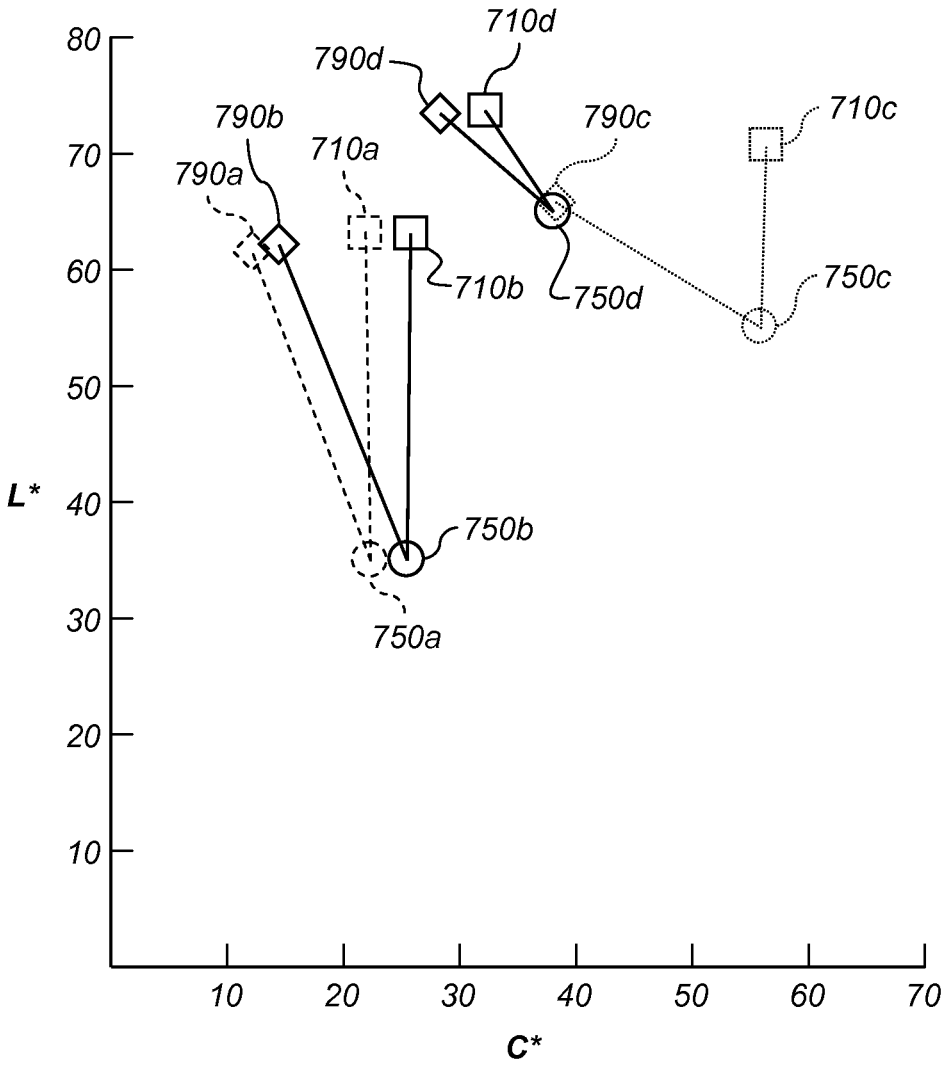
FIG. 7 is a CIELAB L*C* diagram showing color shift between the fold area and the non-fold area according to an embodiment of the present invention.

FIG. 7 is a CIELAB L*C* diagram (referenced to D50) showing color shift between the fold area and the non-fold area according to an embodiment of the present invention. The data in FIG. 7 and Table 1, below, were selected from simulations using various real surface colors. Over 1000 patches were simulated, and selected results are shown here and in Table 1, below. The patches are within the gamut of real surface colors set forth by Pointer (Pointer, M. R. "The gamut of real world surface colors." *Color Research and Application* 5, pp. 145-155 (1980), especially Table II on pg. 152), and as such are examples of typical natural and manmade colors. This figure shows original data ($L^*a^*b^*_{orig}$ 750*a-d*), inventive data ($L^*a^*b^*_{inv}$ 710*a-d*), and comparative data ($L^*a^*b^*_{comp}$ 790*a-d*). Results herein are given to two places after the decimal, where applicable.

Test colors 750*a*, 750*b*, and 750*c* (circles) are the 1976 CIELAB $L^*C^*_{orig}$ coordinates of three colors reproduced in non-fold area 310 (FIG. 3). Test colors 710*a*, 710*b*, and 710*c* (squares) are the $L^*C^*_{inv}$ coordinates of those three colors reproduced in the fold area 350 (FIG. 3). The lines connecting test colors e.g. 750*a* and test colors e.g. 710*a*, and the dotted and dashed styles of the lines and markers, are merely to show which patches are connected.

For test colors 710*a*, 710*b*, and 710*e*, the L* values have increased, and the C* values are approximately unchanged ($L^*_{inv}>L^*_{orig}$; $C^*_{inv}\approx C^*_{orig}$). Specifically, the lightness (L*) of a modified selected test color is higher in the fold area (e.g. test color 710*a*) than the lightness of the corresponding selected test color in the non-fold area (e.g. test color 750*a*). Moreover, the chroma (C*) of a modified selected test color in the fold area (e.g. test color 710*a*) is within 1 unit of the chroma of the corresponding selected test color in the non-fold area (e.g. test color 750*a*). That is, $|\Delta C^*_{inv\text{-}orig}|\leqq 1$ between test color 710*a* and test color 750*a*. In alternative embodiments, $|\Delta C^*_{inv\text{-}orig}|\leqq 2$, $\leqq 5$, or $\leqq 10$. The specific values of points here are shown in Table 1, below.

Increasing L* reduces density in fold area 350 without changing C*, as long as the resulting color (e.g. test color 710*a*) is within the gamut of the printer or CMYK standard in question. When increasing L* moves a test color out of the gamut, C* is reduced to bring the test color to the edge of the gamut boundary. This effect is shown for test color 750*d* (in non-fold area 350). Test color 710*d* (in fold area 310) has higher L* than test color 750*d*, and lower C*. C* has been reduced to bring test color 750*d* into the reproducible gamut.

In the embodiment shown here, an increased L* ($L^*_{inv}$) is calculated from the original L* ($L^*_{orig}$) per Eq. 1:

$$L^*_{inv} = \begin{cases} L^*_{orig}, & \text{if } L^*_{orig} > 80 \\ L^*_{orig} + 100 \times \dfrac{80 - L^*_{orig}}{160}, & \text{otherwise} \end{cases} \quad \text{(Eq. 1)}$$

In other embodiments, various functions can be used, as will be obvious to those skilled in the art. For example, $L^*_{inv}=L^*_{orig}/2+50$ can be used to map the L* range [0, 100] to [50, 100]. Piecewise linear (e.g. Eq. 1), power, and exponential functions can be used.

New $CMYK_{inv}$ values are then calculated for $L^*_{inv}$, $a^*_{orig}$, and $b^*_{orig}$ as described above with reference to FIG. 2. These values are percentages from 0-100%, and the total laydown is the sum of the CMYK values ($\Sigma CMYK_{orig}=C_{orig}+M_{orig}+Y_{orig}+K_{orig}$; likewise for $\Sigma CMYK_{inv}$. These range from 0-400%, preferably from 0-320%). The total laydown is calculated for $CMYK_{orig}$ and for $CMYK_{inv}$ to compute the reduction in total laydown. In an embodiment, the total laydown $\Sigma CMYK_{inv}$ is $\leqq 150\%$ to provide smaller contiguous areas of fused toner and thereby reduce cracking.

For a representative selection of the patches simulated (n>1000), the RMS (average also given separately) total laydown $\Sigma CMYK_{orig}$ was 166.67% (avg. 144.88%), and the RMS total laydown $\Sigma CMYK_{inv}$ was 114.46% (avg. 103.64%). The inventive method reduces $\Sigma CMYK_{inv}$ into the preferred ≦150% range. The RMS reduction in total laydown was 62.43% (avg. 41.24%), indicating that the average patch had $\Sigma CMYK_{inv}=\Sigma CMYK_{orig}$−~62%. Stated differently, the RMS ratio of modified total laydown to original total laydown was 0.82 (average 0.80), indicating that the average patch was reduced in total laydown by about 0.18 times its original total laydown ($\Sigma CMYK_{inv}=\Sigma CMYK_{orig}$−~$0.18\Sigma CMYK_{orig}$).

To more accurately represent the visual effect of this algorithm, those patches having $|\Sigma CMYK_{inv}-\Sigma CMYK_{orig}|\geqq 3$ were analyzed. Small differences in the simulation can result from differences between the CIELAB-CMYK conversion and the CMYK-CIELAB conversion; the two are not exact inverses of each other, so introduce error of 0.5-1 ΔC* in the simulations.

With small-difference patches excluded, the RMS (average also given separately) total laydown $|CMYK_{orig}$ was 196.86% (avg. 185.23%), and the RMS total laydown $\Sigma CMYK_{inv}$ was 129.39% (avg. 123.42%). The inventive method reduces $\Sigma CMYK_{inv}$ into the preferred ≦150% range. The RMS reduction in total laydown was 76.47% (avg. 61.81%), indicating that the average patch had $\Sigma CMYK_{inv}=\Sigma CMYK_{orig}$−~76%. Stated differently, the RMS ratio of modified total laydown to original total laydown was 0.72 (avg. 0.70), indicating that the average patch was reduced in total laydown by about 0.28 times its original total laydown.

It is known in the prior art to reduce density by reducing C, M, Y, and K values by equal percentages. Such a transformation can maintain hue, but can modify both lightness and color. For comparison, the same reduction in total laydown produced by the inventive method described above was applied equally to all four channels of the original $CMYK_{orig}$ data per Eq. 2:

$$X_{comp} = X_{orig} \times \frac{\sum CMYK_{inv}}{\sum CMYK_{orig}} \quad \text{(Eq. 2)}$$

where $X \in \{C, M, Y, K\}$. New $L^*_{comp}$, $a^*_{comp}$, and $b^*_{comp}$ values were then calculated from the modified $CMYK_{comp}$ values using the inverse of the process in FIG. 2. This transformation is well-known in the art. Comparison was then performed between the simulated CIELAB values for the inventive and comparative methods. Points 790*a-d* shown in FIG. 7 and Table 1, below, show the simulated results for this comparative method. Both have the same total laydown; $\Sigma CMYK_{comp}=\Sigma CMYK_{inv}$ by construction. However, the appearance of the colors is very different, as is their fidelity to the original color. Both inventive and comparative have $\Delta H^*_{x\text{-}orig}=0$ (for $x \in \{inv, comp\}$, compared to $H^*_{orig}$) within the limits of roundoff error, but they have very different $\Delta L^*_{x\text{-}orig}$ and $\Delta C^*_{x\text{-}orig}$.

Since $\Delta H^*_{x\text{-}orig}=0$ and $\Delta L^*_{x\text{-}orig}$ is deliberately quite large, since the inventive method is reducing density, $\Delta C^*_{x\text{-}orig}$ is a useful metric for performance comparisons of the two methods. Of the patches simulated, only 183 (13.13%) have $|\Delta C^*_{inv\text{-}orig}|>|\Delta C^*_{comp\text{-}orig}|$. This demonstrates that the inventive method maintains chroma better than the comparative method. Only 24 (1.72%) have $|\Delta\Delta C^*_{inv\text{-}orig}|>(|\Delta C^*_{comp\text{-}orig}|-0.1)$. The maximum $|\Delta C^*_{x\text{-}inv}|-|\Delta C^*_{x\text{-}comp}|$ is 0.55, which is below the threshold of human visibility for chroma-only changes (where $\Delta L^*=\Delta H^*=0$, so $\Delta E^*=\Delta C^*$).

The RMS $\Delta C^*_{comp\text{-}inv}$ is 7.74, indicating that inventive and comparative produce visibly different results. For all colors, including out-of-gamut colors, the RMS $\Delta C^*_{inv\text{-}orig}$ is 15.74, noticeably less than the RMS $\Delta C^*_{comp\text{-}orig}$ of 23.48. This demonstrates that the inventive method does not perform visibly worse for chroma shift than the comparative method, and in most cases, including out-of-gamut cases, performs better. FIG. 7 clearly shows these differences on the L*C* plot. $L^*_{inv}$ and $L^*_{inv}$ are similar, but $C^*_{inv}$ and $C^*_{comp}$ are very different.

TABLE 1

Simulation data for patches shown in FIG. 7

| Point | | Original (750) ○ | Inventive (710) □ | Comparative (790) ◇ |
|---|---|---|---|---|
| a | L* | 35.00 | 63.18 | 61.54 |
| | a* | −10.00 | −9.57 | −1.84 |
| | b* | −20.00 | −19.73 | −12.01 |
| | C* | 22.36 | 21.93 | 12.15 |
| | C | 96.00 | 59.03 | 45.43 |
| | M | 65.17 | 28.82 | 30.84 |
| | Y | 38.61 | 16.82 | 18.27 |
| | K | 21.41 | 0.00 | 10.13 |
| b | L* | 35.00 | 63.14 | 62.19 |
| | a* | 25.00 | 25.41 | 14.41 |
| | b* | −5.00 | −4.57 | −1.65 |
| | C* | 25.50 | 25.82 | 14.50 |
| | C | 49.61 | 25.11 | 23.65 |
| | M | 86.79 | 55.04 | 41.38 |
| | Y | 44.29 | 19.83 | 21.12 |
| | K | 29.00 | 0.00 | 13.83 |
| c | L* | 55.00 | 70.75 | 65.80 |
| | a* | 25.00 | 25.64 | 17.23 |
| | b* | 50.00 | 50.20 | 34.18 |
| | C* | 55.90 | 56.37 | 38.28 |
| | C | 22.98 | 6.70 | 16.09 |
| | M | 62.32 | 46.79 | 43.64 |
| | Y | 100.00 | 82.61 | 70.03 |
| | K | 9.06 | 0.00 | 6.34 |
| d | L* | 65.00 | 73.69 | 73.43 |
| | a* | −15.00 | −14.41 | −9.98 |
| | b* | −35.00 | −28.77 | −26.54 |
| | C* | 38.08 | 32.18 | 28.36 |
| | C | 65.75 | 51.08 | 46.55 |
| | M | 20.77 | 10.40 | 14.70 |
| | Y | 0.32 | 0.00 | 0.23 |
| | K | 0.00 | 0.00 | 0.00 |

Figure 8:
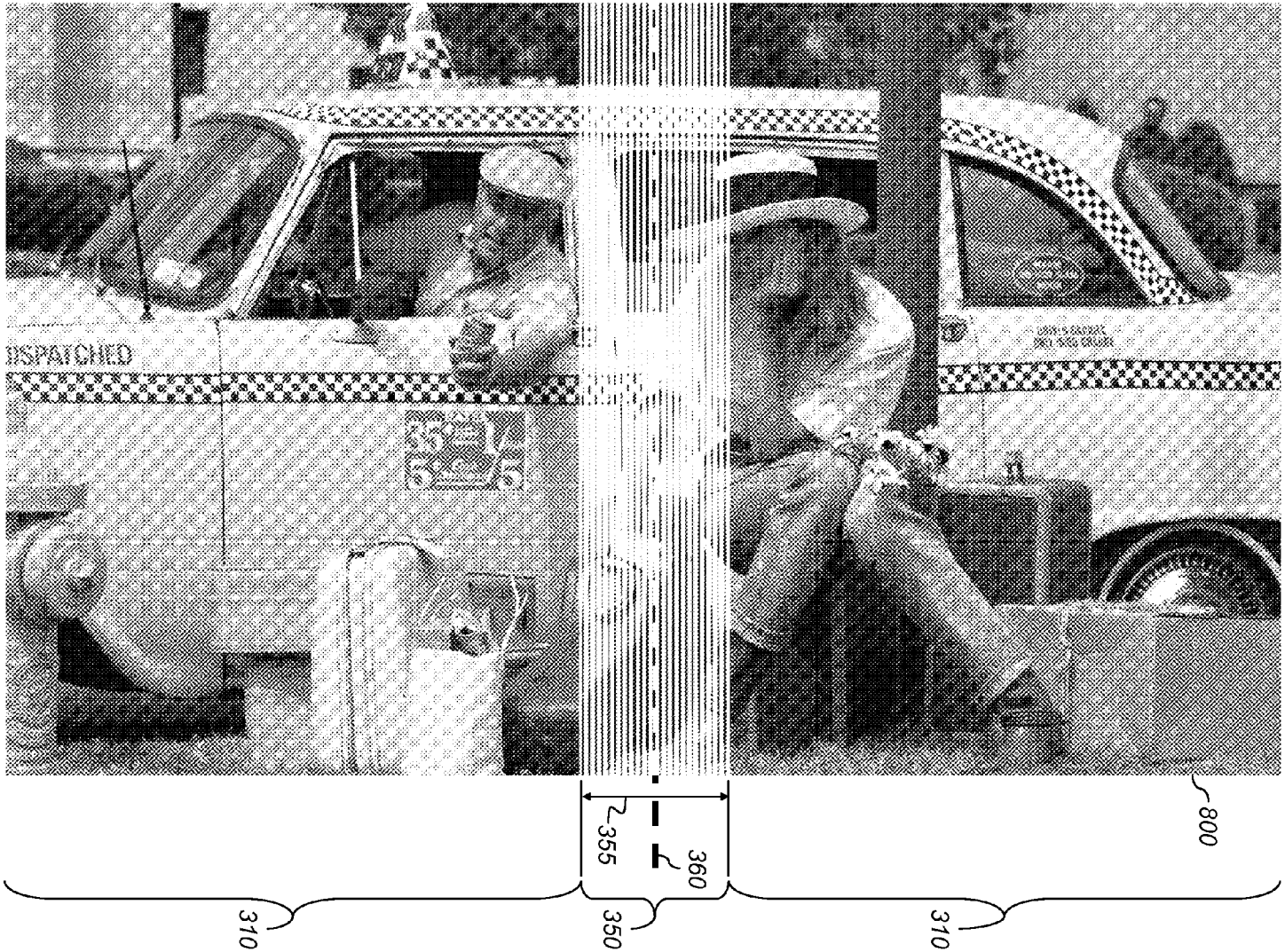
FIG. 8 is a magnified view of a grayscale image halftoned along a fold line according to an embodiment of the present invention.

FIG. 8 is a magnified view of a grayscale image 800 halftoned along a fold axis 360 according to an embodiment of the present invention. Fold area 350, width 355, and non-fold area 310 are as shown in FIG. 3. In this embodiment, a line screen is used in fold area 350, and the density of the image is reduced (the L* is increased) in fold area 350. As can be seen by comparing FIGS. 3 and 8, the halftone lines in fold area 350 are much thinner in FIG. 8 than in FIG. 3. This further reduces the risk of toner cracking at the fold area. The density can be reduced by adjustment in the image-processing path 210 (FIG. 2) or in the screening units 250, 251 (FIG. 2).

In an embodiment, adjustment is performed in the screening units. Non-fold screening pattern 410 (FIG. 4A) and first screening unit 250 produce screened pixel levels 260 (FIG. 2) for each screen cell that range in areal coverage of receiver 42 from 5% to ≧50%, preferably 1%-99%, and more preferably 0%-100%. Fold-area screening pattern 450 (FIG. 4A) and second screening unit 251 produce screened pixel levels 260 for each screen cell that range in areal coverage of receiver 42 from 5% to <50%, preferably 1%-49%, and more preferably 0%-49%. In this way smaller contiguous toner areas are produced using fold-area screening pattern 450 than non-fold screening pattern 410.

In an embodiment, image data in non-fold area 310 are screened with a non-fold screening pattern resulting in a first toner coverage $c_1$ (1-100%) and first toner mass $m_1$ (grams). Image data in fold area 350 is screened with a fold-area screening pattern that deposits toner more heavily in smaller areas, resulting in a second toner coverage $c_2$ and second toner mass $m_2$. Comparing these two patterns, for a flat field, $c_2<c_1$ and $m_2$ is substantially equal to $m_1$. This advantageously reduces cracking by reducing coverage, even though total laydown can be the same.

Figure 12:
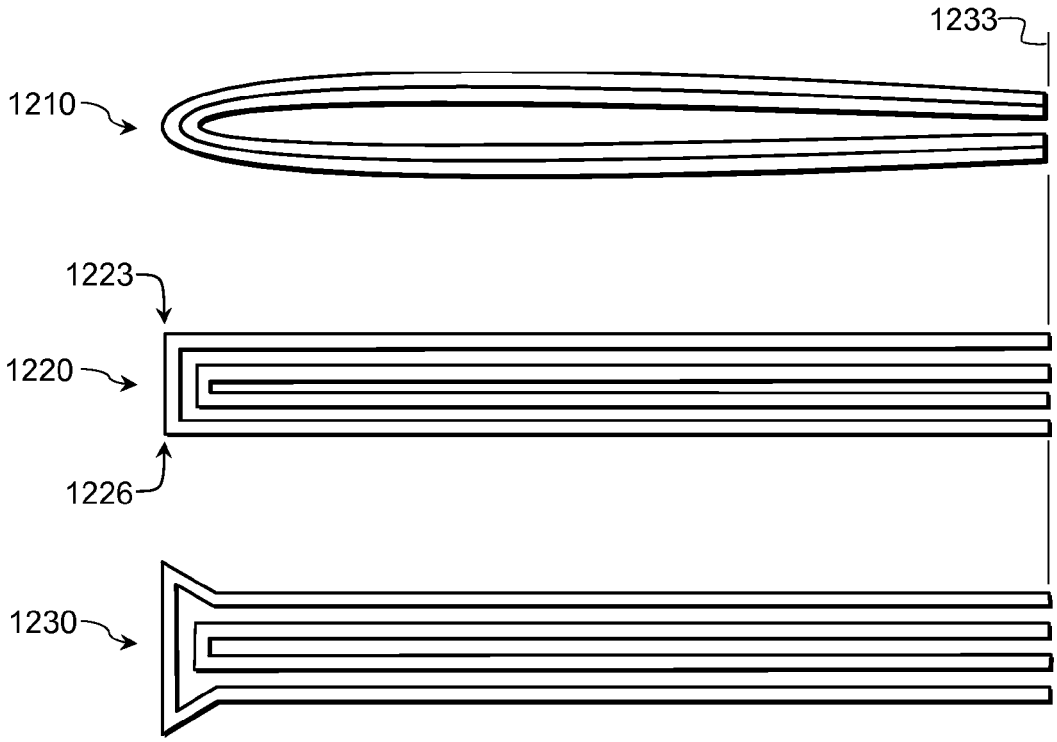
FIG. 12 is an elevation of various shapes of booklet spines.

Referring to FIG. 12, in various embodiments, each sheet is folded once or more than once. This is useful in producing various spine shapes of booklets having flush edges aligned with edge 1233. Shape 1210 shows each sheet folded once and bound e.g. by saddle-stitching. Shape 1220 is a square spine shape, for the production of which each sheet is folded twice. Various methods of practicing the present invention are preferably applied to each fold individually. That is, fold axis 1223 and fold axis 1226 define respective fold areas in which the screening pattern will be modified as described herein. A non-fold area is defined between the respective fold areas defined by fold axes 1223 and 1226, and a transition region as shown in FIG. 6 can also be used as described above. For shape 1230, each sheet is folded four times.

In any booklet, sheets closer to the center can have fewer folds than sheets closer to the cover. For example, in shapes 1220 or 1230, the innermost sheet of the booklet can have a single fold, since the length of the spine covered by that sheet is approximately zero.

Part Two

Various embodiments in Part One, above, describe controlling toner coverage, among other factors stated. Various embodiments below describe controlling screen angle, among other factors stated. Embodiments from both parts can be used singly or in various combinations.

Figure 9:
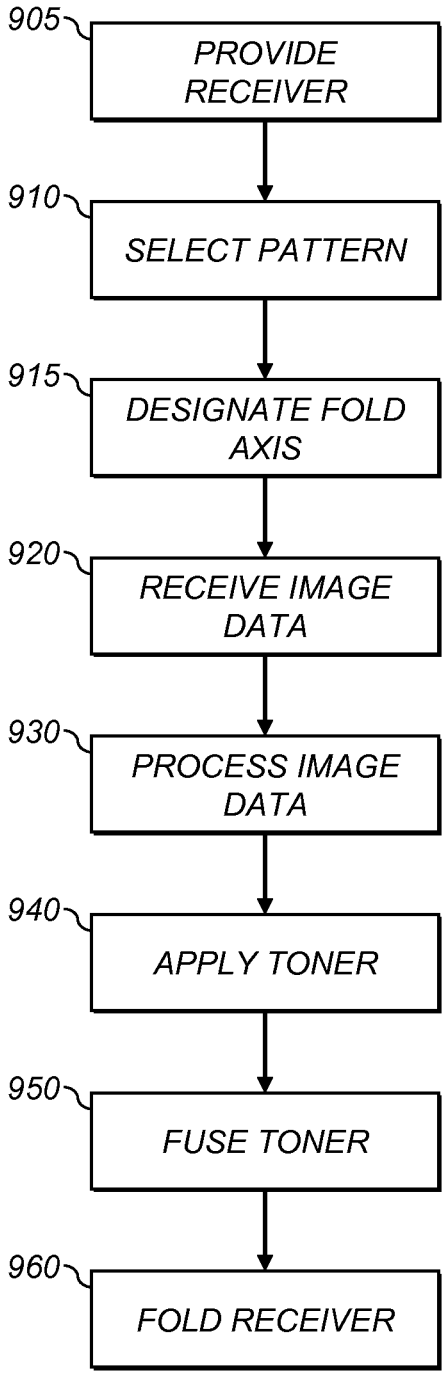
FIG. 9 is a flowchart of a method according to an alternative embodiment of the present invention.

FIG. 9 is a flowchart of a method of operating a printer to apply toner to a receiver according to an alternative embodiment. Processing begins with step 905. In step 905, receiver 42 (FIG. 1) is provided. Receiver 42 has an area to be folded, fold area 350 (FIG. 3), and a separate area not to be folded, non-fold area 310 (FIG. 3), as described above. Step 905 is followed by step 910.

Referring to FIG. 9 and also to FIG. 4B, in step 910, a fold-area screening pattern 450 is selected. Fold-area screening pattern 450 can be a line, dot, diamond, or other type of screening pattern. In an embodiment, the fold-area screening pattern is a line screen. Fold-area screening pattern 450 has a screen frequency, in an embodiment about 50-75 lpi. Fold-area screening pattern 450 has a screen direction 485 making an angle 475 having a magnitude of less than 45° with, or parallel to, direction 445 of fold axis 465. In an embodiment, a non-fold screening pattern is also selected for non-fold area 310 (FIG. 3). The non-fold screening pattern has a screen angle or screen frequency different from the screen angle or screen frequency, respectively, of the fold-area screening pattern. Step 910 is followed by step 915.

Screen frequencies can be selected by those skilled in the art. A coarser fold-area screening pattern provides more space for the fold, as will be described below, but is more objectionable if toner cracks off. A finer fold-area screening pattern provides less space for the fold, but is less objectionable if toner cracks off.

Referring to FIG. 9, and also to FIG. 4B, in step 915, fold axis 465 is designated in fold area 350 (FIG. 3). Fold axis 465 extends in a particular direction 445. When receiver 42 is folded, a fold zone 432 will be produced. Fold zone 432 is the area of the receiver that is bent to a degree sufficient to crack or otherwise damage fused toner when receiver 42 is folded. Fold zone 432 has width 456 and is disposed adjacent to, or contains, the fold axis 465.

After toner (e.g. print image 38, shown in FIG. 1) is fused to receiver 42, one of two results will be obtained, as discussed further below. Step 915 is followed by step 920.

In step 920, image data to be applied to receiver 42 in fold area 350 and non-fold area 310 are received. Step 920 is followed by step 930.

In step 930, the image data in fold area 350 are processed using the fold-area screening pattern to provide screened data, as described above (e.g. as shown in FIG. 2, or other ways of screening obvious to one skilled in the art). In an embodiment, the image data in the non-fold area are processed using the non-fold screening pattern to provide screened data. Step 930 is followed by step 940.

In step 940, the printer is used to automatically apply toner corresponding to the screened data to the receiver, as described above with reference to FIG. 1. Step 940 is followed by step 950.

In step 950, the applied toner is fused to the receiver, as described above with reference to FIG. 1. The result is one or more areas of fused toner (e.g. fused image 39, shown in FIG. 1). Step 950 is followed by step 960.

Figure 10:
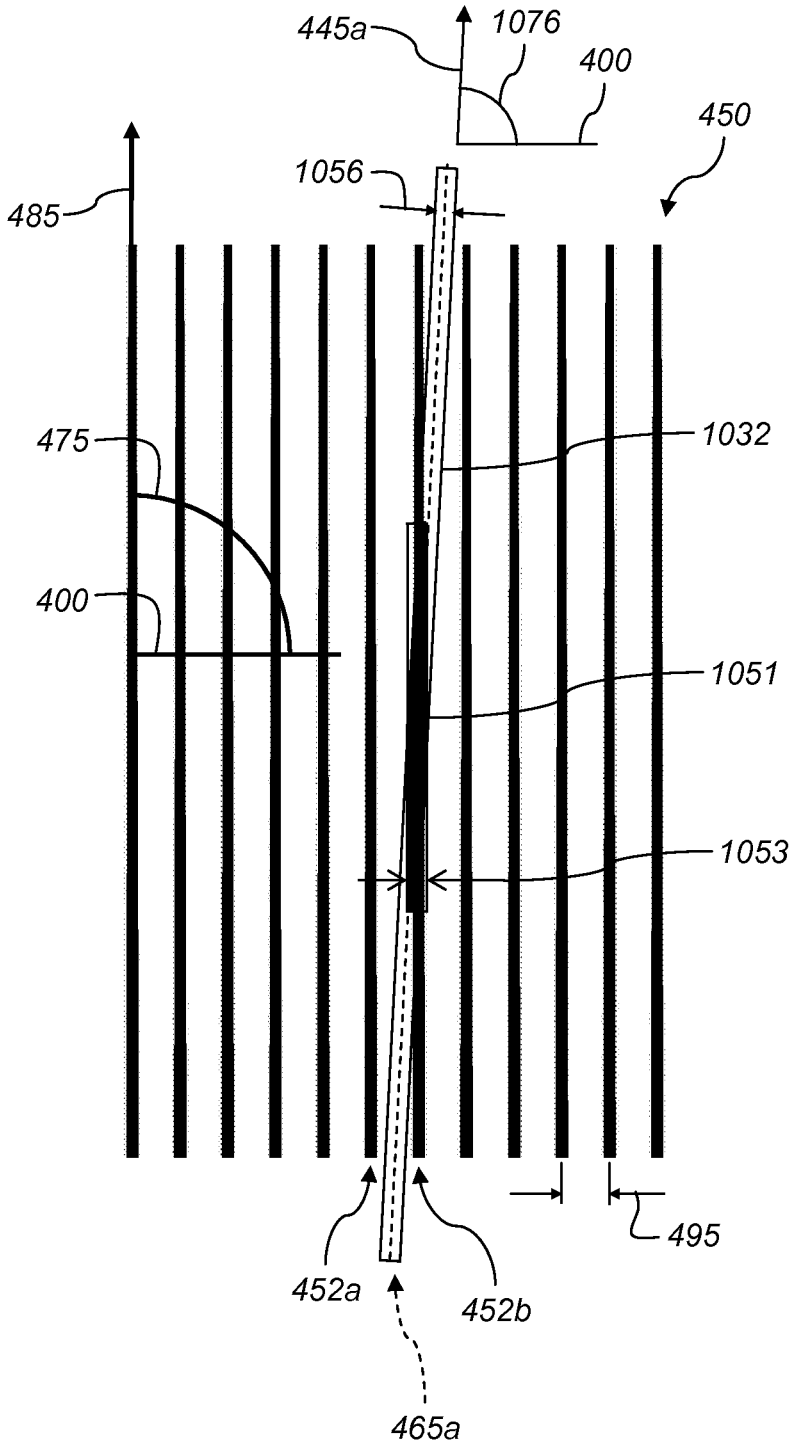
FIG. 10 is a magnified view of a screening pattern useful with the present invention.
Figure 11:
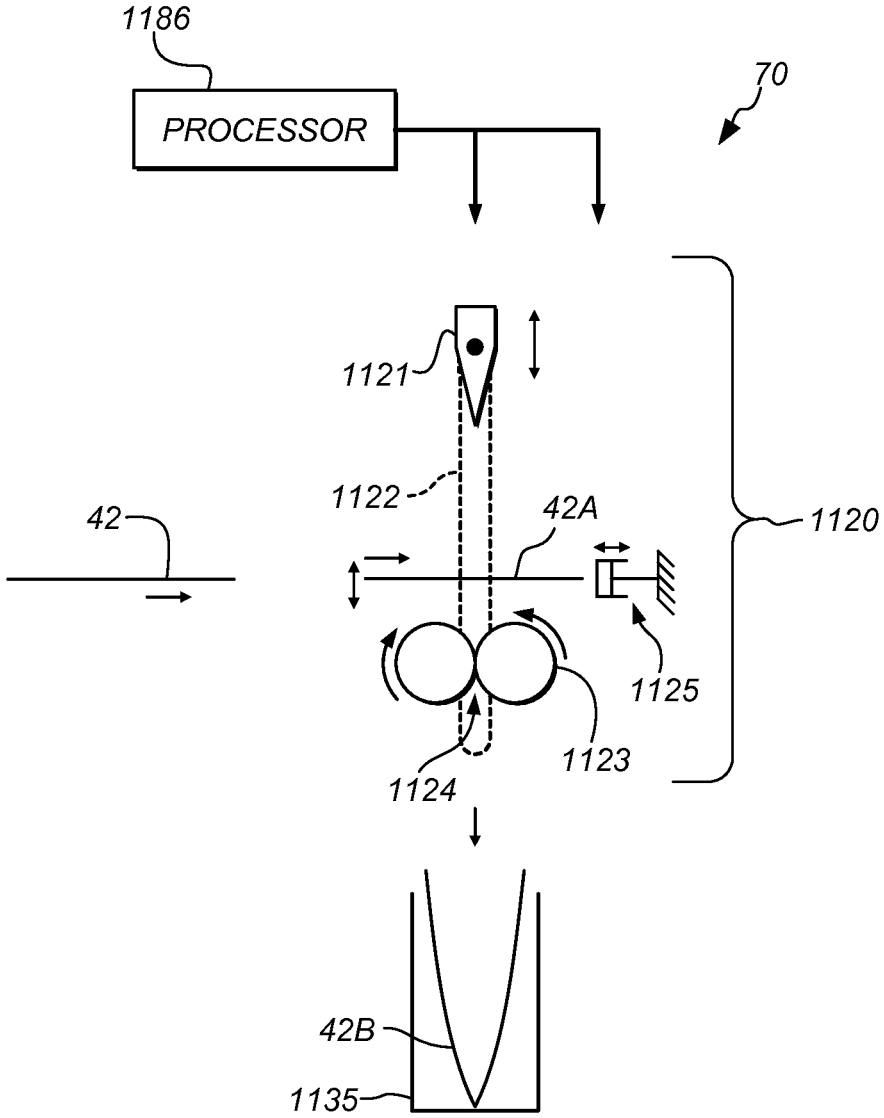
FIG. 11 is an elevation of a folder useful with the present invention.

In step 960, receiver 42 is automatically folded along fold axis (e.g. 465*a*) after the toner is fused to the receiver. Referring to FIG. 10, fold zone 1032 can include the tolerances on folds, so that a fold which is substantially but not exactly along fold axis 465*a* bends receiver 42 in fold zone 1032. By "folded along the fold axis," therefore, it is meant that the receiver that is bent in fold zone 1032, which is defined with reference to fold axis 465*a*, to a degree sufficient to crack or otherwise damage fused toner when receiver 42 is folded. An example of automatic folding apparatus is shown in FIG. 11, with further details below.

The steps of this method can be performed in any order as long as the screening pattern is selected before processing, and the receiver is folded after fusing.

The screening pattern is selected, and the image is processed, so that one of several alternative results is obtained after the toner is fused to the receiver.

Referring to FIG. 4B, one result is that no areas of fused toner will intersect fold zone 432. If no areas of fused toner intersect the fold axis, toner cracking is inherently greatly reduced, as little or no stress is placed on fused toner. In the example of the right-hand side of FIG. 4B, fold-area screening pattern 450 is a line screen with lines oriented parallel to fold axis 465, having a coverage of <100%, and the fold zone and corresponding paper fold along fold axis 465 are laterally contained within a gap between two lines 452*a*, 452*b* of fused toner.

Referring to FIG. 10, an alternative result of the processing is that one or more areas of fused toner will intersect fold zone 1032 and the width 1053 of each area intersecting fold zone 1032 will be less than screen period 495. The width 1053 of each area is measured perpendicular to screen direction 485. This happens when fold axis 465*a* is not exactly (±0°) parallel to screen direction 485, or when fold axis 465*a* is translated from its expected position in a direction not exactly parallel to screen direction 485. The former case is shown here. Both of these errors can be produced by normal printing tolerances.

Fold-area screening pattern 450, baseline 400, screen direction 485, screen angle 475, and screen period 495 are as shown in FIG. 4B. Fold axis 465*a* extends in direction 445*a*, which is not exactly parallel to (within a tolerance of ±0°)

screen direction 485. Fold axis angle 1076 is defined between baseline 400 and direction 445*a*. Since direction 445*a* is not exactly parallel to screen direction 485, fused toner in screen line 452*b* intersects zone 1032 containing fold axis 465*a* in area 1051. Width 1053 of area 1051 is less than screen period 495, width 1053 being measured perpendicular to screen direction 485. Note that area 1051 is not rectangular in shape; width 1053 is defined as the maximum width of area 1051 perpendicular to screen direction 485.

An "area of fused toner" is a contiguous block of fused toner of any color or colors. For example, the digit zero (0) in most fonts is a single area of fused toner, because it is possible to travel from any point in the fused toner forming the zero to any other point in that toner without leaving the area of toner. In another example, a plus sign (+) with a cyan vertical stroke and a magenta horizontal stroke is a single area of fused toner containing the whole plus sign, since the cyan and magenta fused toner areas are in direct contact with each other at at least one point. Areas can have various shapes and sizes, according to the information being printed. Toner cracking can occur when receiver 42 bends underneath an area of fused toner, since fused toner is brittle. In this example, screen lines 452*a* and 452*b* are respective areas of fused toner. Screen line 452*b* has width 1053 perpendicular to screen direction 485, as discussed above. In this example, the maximum width of area 1051 and the width of screen line 452*b* are the same (width 1053), but they can, in general, be different. For example, fold zone 1032 can begin or end in the middle of a screen line (the middle from left to right as shown here), in which case the width of the intersection area is less than the width of the screen line.

Fold zone 1032 has width 1056 perpendicular to direction 445*a*. Although this width can be very small for thin papers and sharp creases, the width is greater than zero. Fold zone 1032 is disposed adjacent to, or contains, fold axis 465*a*. Specifically, the fold zone is an area on one or both sides of fold axis 465*a* having a total width equal to width 1056. In one example, the fold zone extends on each side of fold axis 465*a* half of width 1056 away from the centerline of fold axis 465*a*. That is, the fold zone is symmetrical about fold axis 465*a* with total width 1056.

By "intersect the fold zone" it is meant that an area of fused toner has a non-zero overlap with the fold zone. In this example, area 1051, shown in black, is the intersection of screen line 452*b* and fold zone 1032. The maximum width of area 1051 perpendicular to screen direction 485, which is width 1053, is less than screen period 495. Therefore, screen line 452*b* will experience toner cracking when receiver 42 is folded, but adjacent screen line 452*a* will not. The damage to toner due to cracking is limited in extent when large toner areas do not cross fold axis 465*a*. This advantageously permits the use of higher image densities than other systems. Only densities resulting in large toner areas (width 1053≧screen period 495) need to be reduced to reduce toner cracking. In an embodiment, step 930 (FIG. 9) further includes reducing the toner coverage of regions of image data in fold area 350 having about 100% coverage. Reducing toner coverage is discussed above, in Part One.

The above embodiments have been described with respect to a single separation. However, multiple separations can be used with the present invention. In an embodiment, C, M, Y, and K separations have screen patterns in which areas of toner in and near fold zone 1032 are placed directly on top of each other, extending out of the plane of receiver 42, to leave a lateral gap for fold zone 1032. The screen period is preferably selected to take into account the registration tolerances of printer 100, so that a gap exists between toner areas despite any misregistration.

In an embodiment, the screen period of the fold-area screening pattern is selected based on the radius of curvature of the fold (bend radius). Coarser screens (higher screen period; lower screen frequency) can be used for more gradual bends than for sharper bends or folds.

In an embodiment, the screen period of the fold-area screening pattern is selected based on the tolerances of printer 100 or the printing process. A coarser screen is selected for wider tolerances than for narrower tolerances.

In an embodiment, the fold-area screening pattern has a screen period of 75 lpi, which is similar to a newspaper and is known to be visually acceptable.

In one example, the fold-area screening pattern is a line screen with a screen frequency of 50 lpi, resulting in a screen period of 0.508 mm. General-purpose copy paper (20 lb. bond) has a weight of approximately 75 g/m$^2$, and a corresponding sheet thickness of approximately 0.1 mm. Assuming that the fold is a crease forming a semicircular profile (similar to this: ⊃) with a radius of curvature of one half of the thickness t of the paper, the fold zone has width of $\pi \cdot t/2$, or 0.16 mm. This is about 31% of the screen period, so the fold zone can fit between adjacent toner areas as long as the toner coverage is less than about 69% in the area of the receiver adjacent to the fold zone.

In another example, the screen frequency is 75 lpi, which is commonly used for newspapers. Users are therefore accustomed to seeing 75-lpi screens, so such screens can be used to produce acceptable images. The screen period is about 0.339 mm, so the fold described above is about 47% of the screen period. The fold zone can thus fit without contacting toner areas as long as the toner coverage is less than about 53%.

In yet another example, one or more toner areas do intersect the fold zone. According to various embodiments of the present invention, any toner area intersecting the fold zone has a width perpendicular to the screen direction less than the screen period. For 75 lpi fold-area screening patterns, the maximum toner area lost due to cracking is a strip about 0.339 mm wide. For a piece of paper held 381 mm (15 in.) from the viewer's eye, this crack subtends $\tan^{-1}(0.339/381) \approx 3$ minutes of arc (3 arcmin or 3'). The crack is visible (>1 arcmin), but can be unobjectionable.

At 381 mm (15 in.), one minute of arc (1 arcmin) is subtended by an object of 381 tan(1')≈0.11 mm. This corresponds to a screen frequency of approximately 230 lpi. Therefore, at screen frequencies >230 lpi, a crack will not be readily visible to a human viewer at 15 in. In an embodiment, the fold-area screen period is less than $(230\ \text{lpi})^{-1}$.

Typical printing paper ranges from 60 g/m$^2$-120 g/m$^2$, with heavier weights possible, e.g. 270 g/m$^2$ greeting card stock, or up to 400 g/m$^2$ stock. The above calculations can be used for any weight of paper. Receivers of other materials can also be used, with their thicknesses being used in the calculations above.

Referring to FIG. 11, there is shown an embodiment of a folder useful with the present invention. The folder can be included as part of finisher 70 (FIG. 1). Receiver 42 enters the folder, as shown. Folder 1120 includes blade 1121 riding in track 1122 to press receiver 42A into rollers 1123. Receiver 42A is positioned over rollers 1123 and held in place by a belt, transport roller, vacuum chuck or other retention mechanism. Adjustable paper stop 1125 positions the center of receiver 42A (e.g. fold axis 465, shown in FIG. 4B) under the point of blade 1121. Blade 1121 slides down track 1122 and presses receiver 42A into nip 1124 formed between rollers 1123.

Rollers 1123 rotate to take up receiver 42A into nip 1124, so that receiver 42A is folded by being pinched and creased between rollers 1123. Blade 1121 then rides back up track 1122. Rollers 1123 continue turning and receiver 42A falls out of the folder into holder 1135 (folded receiver 42B shown). Processor 1186, which can be a CPU, FPGA, PLD, PAL, or other logic device, controls the operations of paper stop 1125, blade 1121, rollers 1123, and other components of folder 1120.

In another embodiment, a buckle folder can be employed with the present invention. An exemplary buckle folder useful with the present application is shown in commonly-assigned U.S. Pat. No. 5,108,082 to Shea et al., the disclosure of which is incorporated herein by reference.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

| | |
|---|---|
| 31, 32, 33, 34, 35 | printing module |
| 38 | print image |
| 39 | fused image |
| 40 | supply unit |
| 42, 42A, 42B | receiver |
| 50 | transfer subsystem |
| 60 | fuser |
| 62 | fusing roller |
| 64 | pressure roller |
| 66 | fusing nip |
| 68 | release fluid application substation |
| 69 | output tray |
| 70 | finisher |
| 81 | transport web |
| 86 | cleaning station |
| 99 | logic and control unit (LCU) |
| 100 | printer |
| 200 | input pixel levels |
| 205 | workflow inputs |
| 210 | image-processing path |
| 220 | output pixel levels |
| 250, 251 | screening unit |
| 260 | screened pixel levels |
| 270 | print engine |
| 300 | image |
| 310 | non-fold area |
| 350 | fold area |
| 355 | width |
| 360 | fold axis |
| 400 | baseline |
| 410 | non-fold screening pattern |
| 432 | fold zone |
| 441, 444, 445, 445a | direction |
| 450 | fold-area screening pattern |
| 452a, 452b | screen line |
| 456 | width |
| 461, 465, 465a | fold axis |

-continued

| | |
|---|---|
| 468 | density |
| 471, 475 | screen angle |
| 481, 485 | screen direction |
| 491, 495 | screen period |
| 510 | step Select Patterns |
| 520 | step Receive Image Data |
| 530 | step Process Image Data |
| 540 | step Apply Toner |
| 550 | step Fuse Toner |
| 560 | step Fold Receiver |
| 600 | image |
| 610 | boundary |
| 626 | image |
| 650 | boundary |
| 690 | transition area |
| 695 | width |
| 710a, 710b, 710c, 710d | test color (in the area to be folded) |
| 750, 750b, 750c, 850d | test color (in the area not to be folded) |
| 790a, 790b, 790c, 790d | test color (comparative) |
| 800 | image |
| 905 | step Provide Receiver |
| 910 | step Select Pattern |
| 915 | step Designate Fold Axis |
| 920 | step Receive Image Data |
| 930 | step Process Image Data |
| 940 | step Apply Toner |
| 950 | step Fuse Toner |
| 960 | step Fold Receiver |
| 1032 | fold zone |
| 1051 | area |
| 1053 | width |
| 1056 | fold zone width |
| 1076 | fold axis angle |
| 1120 | folder |
| 1121 | blade |
| 1122 | track |
| 1123 | rollers |
| 1124 | nip |
| 1125 | paper stop |
| 1135 | holder |
| 1186 | processor |
| 1210, 1220, 1230 | shape |
| 1223, 1226 | fold axis |
| 1233 | edge |

The invention claimed is:

1. A method of operating a printer to apply toner to a receiver, comprising:

providing the receiver with an area to be folded and a separate area not to be folded;

selecting a fold-area screening pattern having a screen period, and having a screen direction;

designating a fold axis in the area to be folded, the fold axis extending in a particular direction, that makes an angle having a magnitude of less than 45° with the screen direction, so that when the receiver is folded, a fold zone will be produced having a width and disposed adjacent to, or containing, the fold axis, and after toner is fused to the receiver, either i) no areas of fused toner will intersect the fold zone; or ii) one or more areas of fused toner will intersect the fold zone and the width of each area measured perpendicular to the screen direction intersecting the fold zone will be less than the screen period;

receiving image data to be applied to the receiver in the area to be folded;

processing the image data in the area to be folded using the fold-area screening pattern to provide screened data; wherein the processing step further includes reducing the toner coverage of regions of image data in the area to be folded having about 100% coverage;

using the printer to apply toner corresponding to the screened data to the receiver; and fusing the applied toner to the receiver.

2. The method according to claim 1, further including automatically folding the receiver along the fold axis after the toner is fused to the receiver.

3. The method according to claim 1, wherein the screen frequency is about 50-75 lpi.

4. The method according to claim 1, wherein at least one area of fused toner intersects the fold axis.

5. The method according to claim 1, further including:

selecting a non-fold screening pattern having a screen angle or screen frequency different from the screen angle or screen frequency, respectively, of the fold-area screening pattern; and processing the image data in the area not to be folded using the non-fold screening pattern to provide screened data.

6. The method according to claim 1, wherein the fold-area screen is a line screen.

7. The method according to claim 1, wherein the area to be folded is less than or equal to 8 mm wide.

8. The method according to claim 1, wherein a width of the area to be folded is proportional to the thickness of the receiver.

* * * * *